US006651939B2

(12) United States Patent
Bischoff et al.

(10) Patent No.: US 6,651,939 B2
(45) Date of Patent: Nov. 25, 2003

(54) SHOWER FITTING HOLDER

(75) Inventors: Bernd Bischoff, Hemer (DE); Sascha Körfer, Hemer (DE); Stefan Salomon, Bielefeld (DE); Thomas Salomon, Gütersloh (DE)

(73) Assignee: Friedrich Grohe AG & Co. KG, Hemer (DE)

( * ) Notice: Subject to any disclaimer, the term of this patent is extended or adjusted under 35 U.S.C. 154(b) by 0 days.

(21) Appl. No.: 10/169,532

(22) PCT Filed: Nov. 8, 2001

(86) PCT No.: PCT/EP01/12890

§ 371 (c)(1),
(2), (4) Date: Oct. 8, 2002

(87) PCT Pub. No.: WO02/44482

PCT Pub. Date: Jun. 6, 2002

(65) Prior Publication Data

US 2003/0168559 A1 Sep. 11, 2003

(30) Foreign Application Priority Data

Nov. 29, 2000 (DE) ..... 100 59 212

(51) Int. Cl.[7] ..... A62C 13/76
(52) U.S. Cl. ..... 248/75; 4/615; 239/283

(58) Field of Search ..... 248/75, 200; 4/615; 239/283, 588

(56) References Cited

U.S. PATENT DOCUMENTS

| | | | | |
|---|---|---|---|---|
| 5,340,064 A | | 8/1994 | Heimann et al. | 248/75 |
| 6,361,005 B1 | * | 3/2002 | Faisst et al. | 248/219.4 |
| 6,502,796 B1 | * | 1/2003 | Wales | 248/316.1 |

FOREIGN PATENT DOCUMENTS

| | | | |
|---|---|---|---|
| DE | 198 02 917 A1 | * | 1/1998 |
| DE | 298 01 155 | | 5/1998 |
| EP | 0 529 347 | | 3/1993 |

* cited by examiner

*Primary Examiner*—Ramon O. Ramirez
(74) *Attorney, Agent, or Firm*—Herbert Dubno; Andrew Wilford

(57) ABSTRACT

In a shower-head holder having a bracket (1) fixed on a wall or on a wall rod and a holder body (2) pivotal on a pin (10), the holder body (2) having at lest one friction face that bears under an adjustable spring force on at least one surface fixed rotationally on the bracket (1), it is proposed that the pin (10) be angularly fixed to the bracket (1), the holder body (2) engaging around the pin (10) with a sleeve (20) and being connected via a plate-type brake with the bracket.

14 Claims, 4 Drawing Sheets

5
51
10
2
21
20
50
4
101
3
6
1
21
61
60
70
8
II
II
7
71
1
11
10
100
130
14
14

SHOWER FITTING HOLDER

CROSS REFERENCE TO RELATED APPLICATIONS

This application is the US national phase of PCT application PCT/EP01/12890 filed Nov. 8, 2001 with a claim to the priority of German patent application 10059212.0 itself filed Nov. 29, 2000.

FIELD OF THE INVENTION

The invention relates to a shower-head holder with a bracket mounted on a building wall or a wall rod and on which a holder body is pivotal about an axis, the holder body having at least one friction surface that is pressed by an adjustable spring element against at least one stationary surface on the bracket.

BACKGROUND OF THE INVENTION

A shower-head holder of this type is known from European patent document EP 0,529,347. In this holder the bracket is fixed directly to a building wall. In addition it is however also known to mount the bracket at a spacing from the wall on a wall rod such that the bracket can be slid along the wall rod and arrested at any desired position. This holder has however only a relatively small friction surface so that due to low friction only a reduced braking effect is achieved and as a result the shower head is provided close to the pivot axis so that the brake effect is sufficient to hold the shower in the various pivoted positions.

OBJECT OF THE INVENTION

It is an object of the invention to provide a showerhead holder with a relatively long pivotal holder that ensures a sure holding of the shower head in the various pivoted positions for a long service life.

SUMMARY OF THE INVENTION

This object is achieved in that the axis is fixed on the bracket, the holder has a sleeve surrounding the axis, and a plate-type brake joins the holder to the bracket.

With these features, thanks to the good braking effect the holder can be provided with a long pivot arm. The proposed brake is thus low in friction and very compact and small so that the outside measurements of the device and the design constraints of a plumbing fixture can be respected.

In a further embodiment of the invention the braking effect in the installed shower-head holder can be set and/or adjusted by an externally accessible adjustment mechanism. Preferably the braking effect is set on manufacture to a predetermined braking torque. After some time when the parts have worked in or worn, a simple resetting of the adjustment mechanism can compensate out this problem so that the shower-head holder will hold in any pivotal position but can still be easily moved by the user by hand to any desired pivotal position.

BRIEF DESCRIPTION OF THE DRAWING

An embodiment of the invention is shown in the drawing and is more closely described in the following. Therein

SPECIFIC DESCRIPTION

Figure 1:
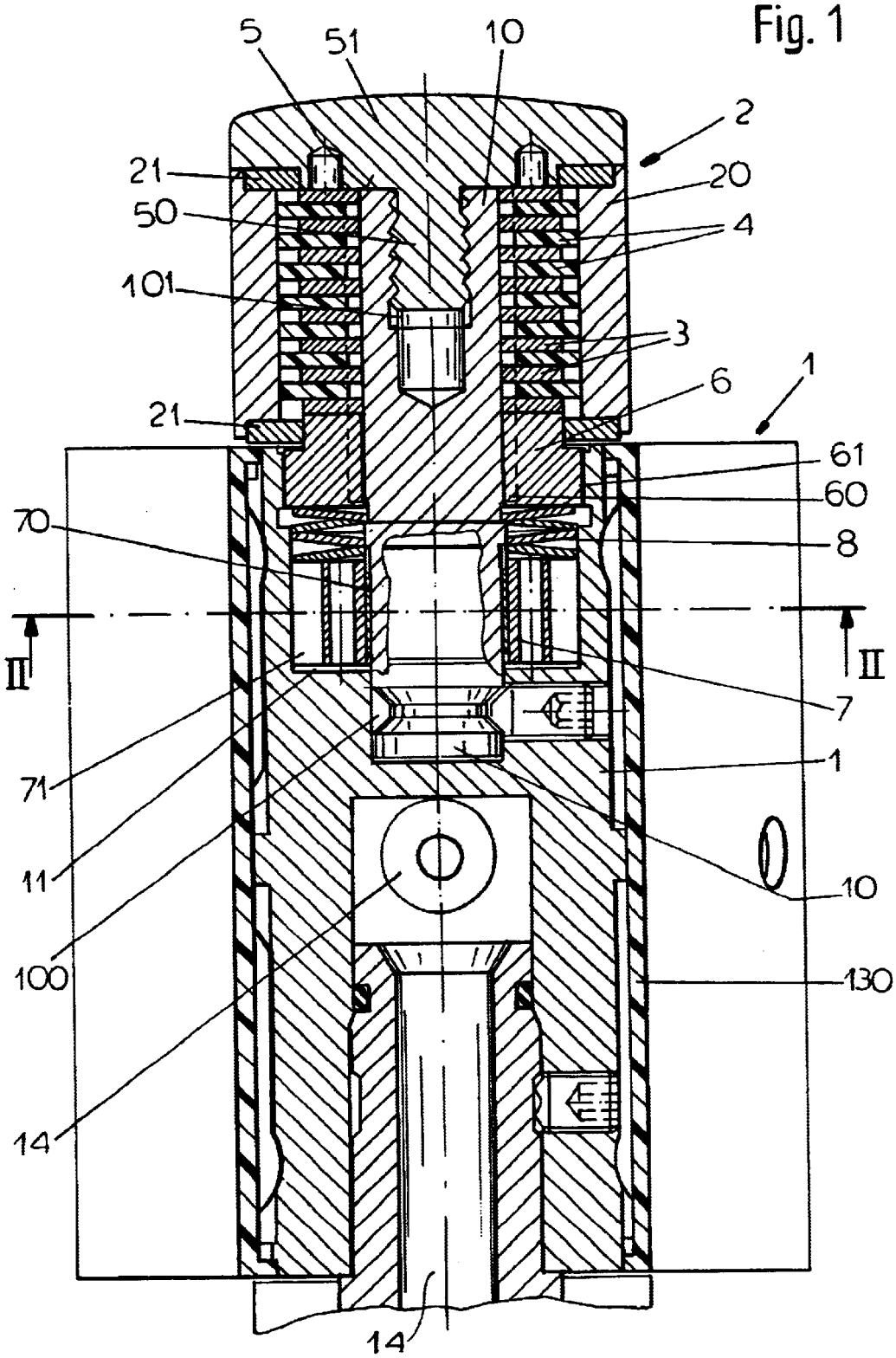
FIG. 1 is a partial view of a shower-head holder taken in a section along plane I of FIG. 2.
Figure 2:
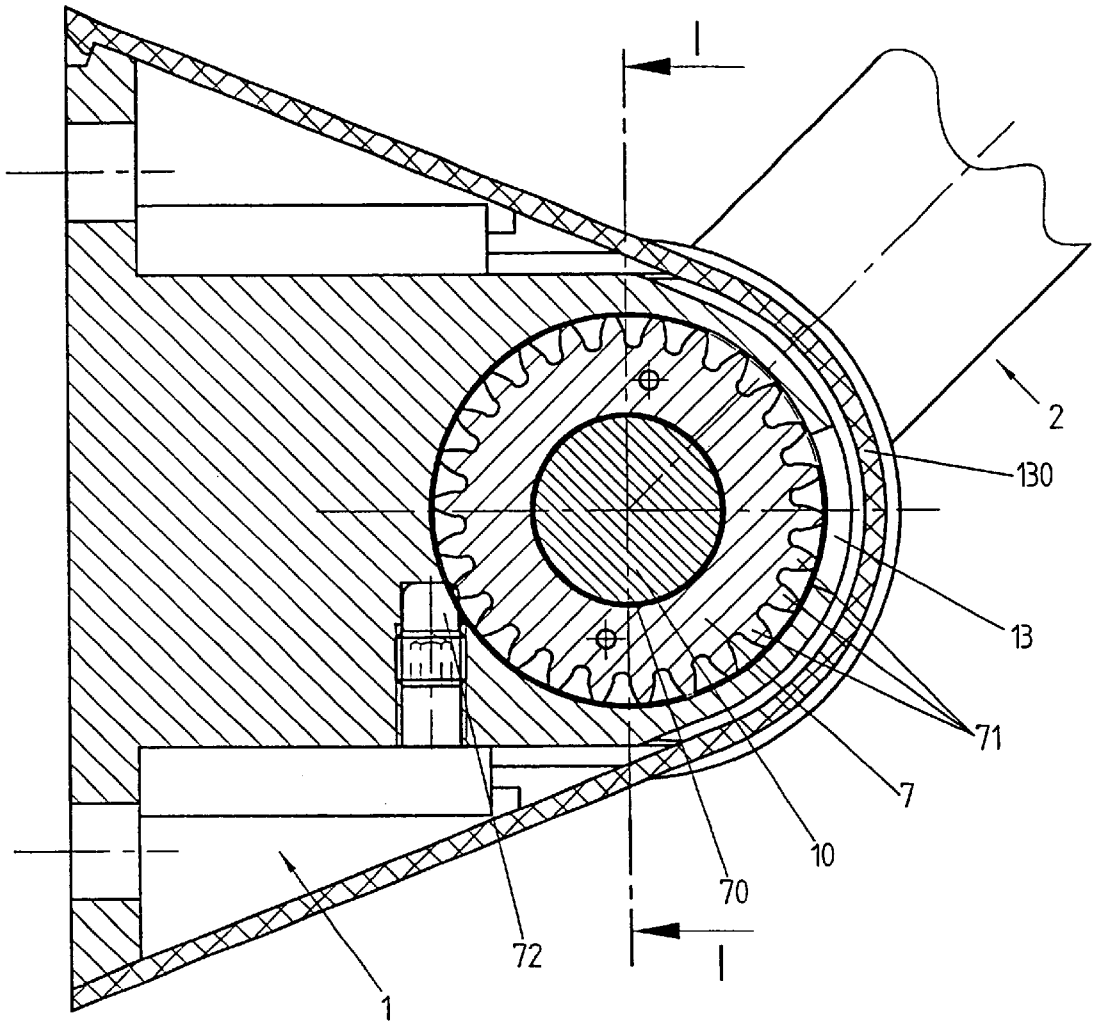
FIG. 2 is the shower-head holder shown in FIG. 1 in section plane II.
Figure 3:
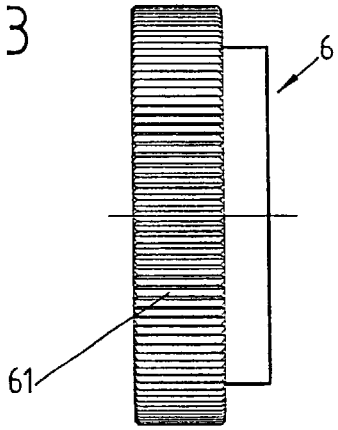
FIG. 3 is a side view of the pusher ring shown in FIG. 1.

The shower-head holder partially shown in FIGS. 1 and 2 of the drawing is formed mainly by a bracket 1 fixed on a building wall and having at least one pivot pin 10 on which pivots a holder body 2 with a sleeve 20, so that one or more unillustrated shower heads can be fitted to the holder body 2. Between an outer face of the pivot pin 10 and an inner face of the sleeve 20 there is a plate-type brake that is set up so that on the one hand the user can pivot the holder body 2 easily on the pin 10 and on the other hand however the holder body 2 will sit stably in the selected pivoted position.

Figure 5:
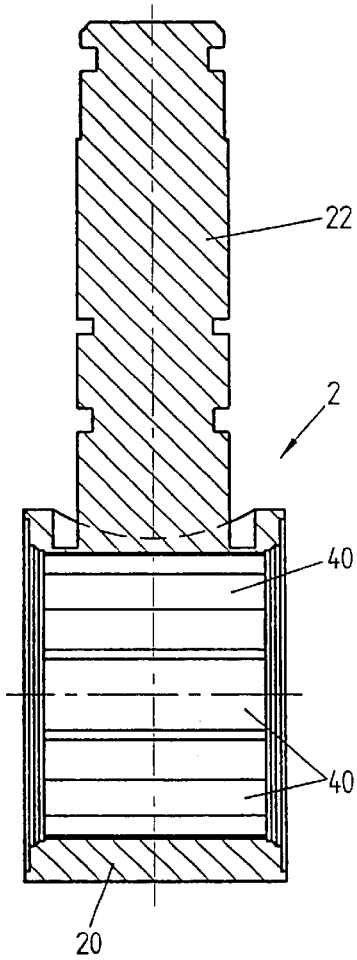
FIG. 5 shows a part of the holder body shown in FIG. 1 in longitudinal section.
Figure 6:
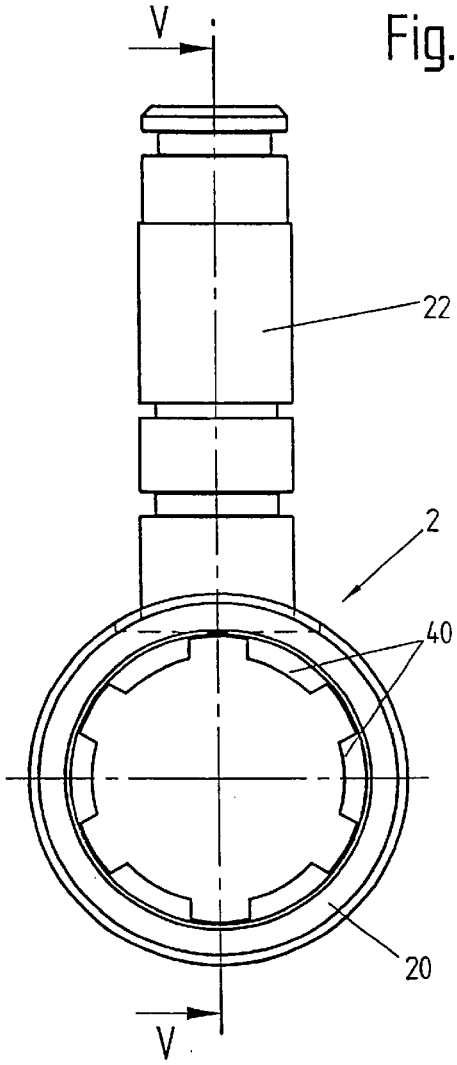
FIG. 6 is the body shown in FIG. 5 turned 90° and in side view.
Figure 11:
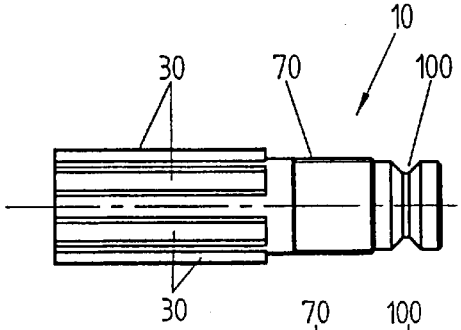
FIG. 11 shows the pivot pin shown in FIG. 1 in smaller scale.
Figure 12:
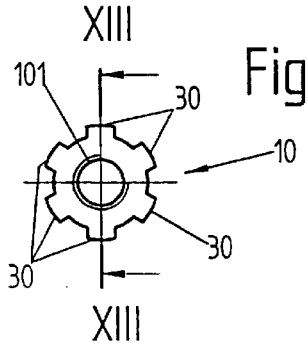
FIG. 12 is the pivot pin shown in FIG. 11 turned through 90°.
Figure 13:
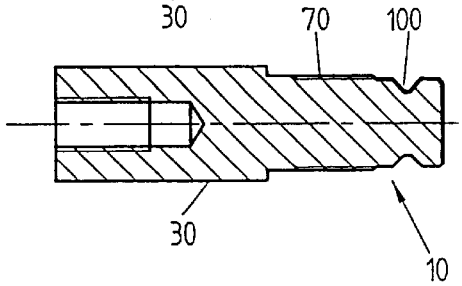
FIG. 13 is the pivot pin shown in FIG. 12 along section plane XIII.
Figure 14:
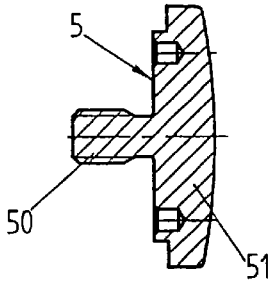
FIG. 14 shows the disk shown in FIG. 1 in smaller scale.
Figure 15:
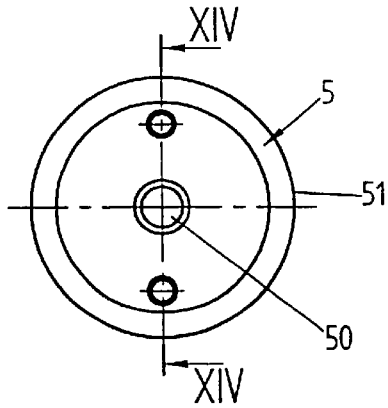
FIG. 15 is a view of the disk shown in FIG. 14 turned through 90°.

The bracket 1 is formed at one end with a horizontally open blind bore 11 in which the pin 10 is seated and in which it is secured by a radial screw 12 engaging in a peripheral groove 100. A center region of the pin 10 has a screwthread 70 for a tension nut 7. The end of the pin 10 opposite the groove 100 is of larger diameter and has splines 30 as best seen in FIGS. 11 and 12. A disk 51 with a threaded stem 50 is fitted in a threaded bore 101 in the outer end of the pin 10. The disk 51 forms a shoulder 5 that bears against the end of the pin 10. The sleeve 20 also has on its inner surface splining 40 as best seen in FIGS. 5 and 6. In addition the sleeve 20 is provided with a radial arm 22 on which is fixable a tubular holder body 2 (FIG. 2). The ends of the sleeve 20 are each formed with a seat for a respective slide ring 21. The two slide rings 21 serve primarily as radial bearings so that no radial forces are brought to bear on the plate stack.

Figure 7:
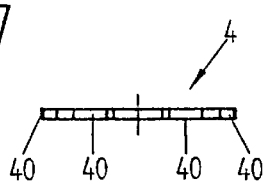
FIG. 7 shows the sleeve washer shown in FIG. 1 in smaller scale and side view.
Figure 9:
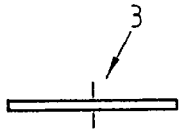
FIG. 9 shows the pin washer shown in FIG. 1 in smaller scale and side view.
Figure 8:
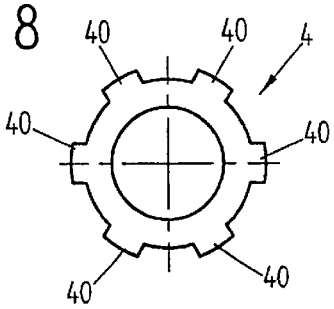
FIG. 8 is the sleeve washer shown in FIG. 7 turned through 90°.
Figure 10:
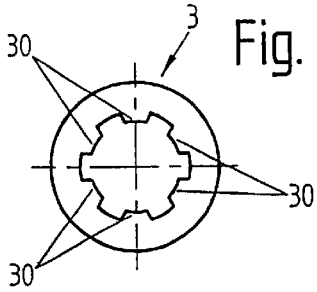
FIG. 10 is the pin washer shown in FIG. 8 turned through 90°.

The plate-type brake provided between the pin 10 and the sleeve 20 is formed by the tension nut 7, a spring 8 secured by the tension nut 7 and formed by spring washers, as well as by alternating stainless-steel pin washers 3 and polyethylene sleeve washers 4. The pin washers 3 are rotationally fixed by the splining 30 as visible in FIG. 10 of the drawing but are axially shiftable, the washer stack having at each end a pin washer 3. The sleeve washers 4 shown in detail in FIGS. 7 and 8 of the drawing are formed with splining 40 but are axially shiftable in the sleeve 20. As particularly visible in FIG. 1 of the drawing, alternating pin washers 3 and sleeve washers 4 are stacked between the pin 10 and the sleeve 20 with the end pin washer 3 bearing on the shoulder 5 of the disk 51 and at the other end another pin washer 3 bearing on the end face of the pusher ring 6.

Figure 4:
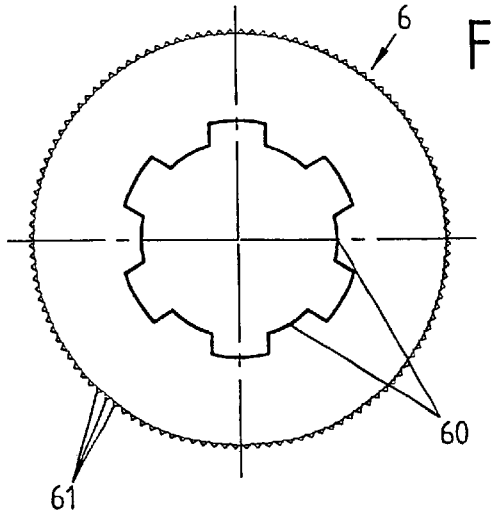
FIG. 4 is the pusher ring shown in FIG. 3 turned through 90°.

The pusher ring 6 is formed with internal teeth 60 and external teeth 61 as in particular shown in FIG. 4 of the drawing. The inner wall surface of the bore seat 11 is complementary to the teeth 61 so that when fitted together the pusher ring 6 is axially shiftable but angularly fixed between the bracket 1 and the pin 10.

Figure 16:
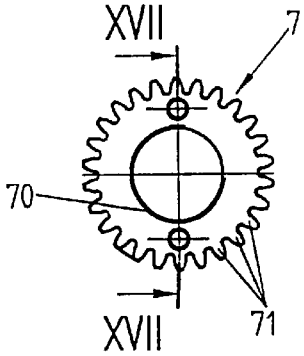
FIG. 16 shows the tensioning nut shown in FIG. 2 in smaller scale and side view.
Figure 17:
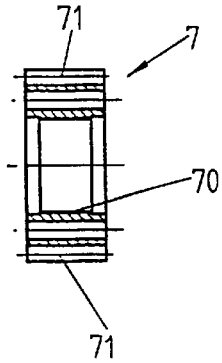
FIG. 17 is the tension nut shown in FIG. 16 along section plane XVII.

The outer surface of the tension nut 7 is also formed with teeth 71 as in particular shown in FIGS. 16 and 17. The inner wall of the blind bore 11 of the bracket 1 is formed level therewith with a window 13 at which the teeth are exposed and the tension nut 7 can be turned, e.g. with the blade of a screwdriver, so that the position of the tension nut 7 on the pin 10 is settable. In order to prevent unintended actuation of the tension nut 7, the bracket 1 holds a set screw 72 extending tangentially of the tension nut 7 and by means of which the desired angular position of the tension nut 7 can be fixed. In order to prevent unintended actuation of the tension nut, the bracket 1 is provided with a cover 130 that engages over the window 13 and set screw 72. The cover 130 also complies with the style of the bracket 1.

The shower-head holder can be assembled in the following manner:

First the disk 51 is mounted on the pin 10. Then the sleeve 20 of the holder body 2 fitted with the slide rings 21 can be fitted over the pin 10 until it seats on the shoulder 5. Then the pin washers 3 and the sleeve washers 4 are dropped alternatingly one after the other into the annular space between the sleeve 20 and the pin 10. Subsequently the pusher ring 6 is slid onto the teeth 30 to seat against the inner end pin washer 3. Then the spring 8 is mounted and finally the nut 7 is screwed up on the screwthread 70 of the pin 10. Then the assembled brake with the end portion of the pin 10 carrying the tension nut 7 is inserted into the blind bore 11 axially so that the pusher ring 6 engages with its external teeth 61 in the corresponding internal teeth 61 on the inner surface of the bore 11, thereby angularly coupling the pin 10 with the bracket 1. When fitted together the radial screw 12 is screwed into the groove 100 of the pin 10 so that the pin 10 is axially fixed in the bracket 1. The holder body 2 is fitted on the radial arm 22 of the sleeve 20. Finally the cover 130 is fitted to the bracket 1.

In order to set or adjust the braking effect, once the cover 130 has been removed and the set screw 72 has been backed off, the tension nut 7 is rotated through the window 13 on the screwthread 70 so that the axial position and the axial pressure effective on the washer stack is changed. The orientation of the window 13 in the bracket 1 makes it easy to subsequently adjust the braking effect in a shower-head holder already mounted on a building wall.

Water is fed to the unillustrated shower head via a passage 14 in the bracket 1 and an unillustrated feed pipe extending parallel to the radial arm 22 on the opposite side of the bracket 1. Alternately the shower head can be connected via a hose to the water supply, in which case the shower head is either stationary on the shower-head holder or is constituted as a telephone shower fitted to the shower-head holder.

In the above-described embodiment the bracket 1 is mounted directly on the building wall. Of course the bracket can also be formed such that it is vertically positionable on a wall rod spaced from the building wall.

What is claimed is:

1. A shower-head holder comprising:

a bracket formed with a pivot pin centered on an axis and having a pair of axially confronting faces spaced along the pin;

a holder adapted to carry a shower head and having a sleeve surrounding the pin and rotatable about the axis on the pin;

a brake having a sleeve plate angularly fixed to the sleeve adjacent one of the faces, a bracket plate angularly fixed to the bracket and engaged between the sleeve plate and the other of the faces, and means for urging the faces toward each other and thereby pressing the plates axially against each other, whereby friction between the plates brakes pivoting of the holder on the bracket.

2. The shower-head holder defined in claim 1 wherein the bracket plate is of metal and the sleeve plate is of plastic.

3. The shower-head holder defined in claim 2 wherein the bracket plate is of stainless steel and the sleeve plate is of polyethylene.

4. The shower-head holder defined in claim 1 wherein the bracket includes a pusher ring angularly fixed on the bracket, axially displaceable on the pin, and forming the one face and the pin has a shoulder forming the other face, the urging means being a spring braced axially between the ring and the bracket.

5. The shower-head holder defined in claim 2 wherein the bracket is formed with a blind bore receiving an end of the pin, the spring, and the nut.

6. The shower-head holder defined in claim 5 wherein the ring has internal teeth fitted with the pin and locking it angularly thereto and external teeth fitted with the bracket and locking it angularly thereto.

7. The shower-head holder defined in claim 5, further comprising a lock screw engages through the bracket into the blind bore with the pin to lock the pin axially to the bracket.

8. The shower-head holder defined in claim 5 wherein the spring is formed by a stack of spring washers.

9. The shower-head holder defined in claim 1 wherein the sleeve is fitted with slide rings engaging the pin and allowing the sleeve to pivot about the axis on the pin.

10. The shower-head holder defined in claim 1, further comprising a nut threaded on the pin, the spring being braced axially between the nut and the ring, whereby rotating the nut on the pin alters the compression of the spring.

11. The shower-head holder defined in claim 10 wherein the nut has external teeth and is recessed in the bracket, the bracket being formed with a window through which the teeth are-exposed, whereby the nut can be rotated by means of a tool engaging through the window with the external nut teeth.

12. The shower-head holder defined in claim 11, further comprising a removable cover on the bracket overlying the window.

13. The shower-head holder defined in claim 11, further comprising a screw threaded in the bracket and engageable with the external nut teeth to arrest the nut relative to the pin.

14. The shower-head holder defined in claim 1 wherein the pin includes a disk forming the other face and having a stem threaded axially into the pin.

* * * * *